US005361792A

United States Patent [19]

Lin et al.

[11] Patent Number: 5,361,792

[45] Date of Patent: Nov. 8, 1994

[54] RELIABLY OPERATED AUTOMATIC UMBRELLA WITH UPWARDLY AND DOWNWARDLY THRUSTED PUSH BUTTON

[76] Inventors: Chung-Kuang Lin; Jung-Jen Chang, both of No. 16, Chen Tai Road, Sec. 3, Wu Ku Hsiang, Taipei Hsien, Taiwan, Prov. of China

[21] Appl. No.: 237,873

[22] Filed: May 3, 1994

[51] Int. Cl.[5] ..... A45B 25/14

[52] U.S. Cl. ..... 135/24; 135/25.1; 135/38

[58] Field of Search ..... 135/22–24, 135/25.1, 25.33, 25.41, 28, 37, 38, 39, 40, 41

[56] References Cited

U.S. PATENT DOCUMENTS 3,856,030 12/1974 Sato ..... 135/22
4,534,374 8/1985 Day ..... 135/22
4,825,888 5/1989 Su ..... 135/24 X
5,224,505 7/1993 Wu ..... 135/24
5,232,004 8/1993 Wu ..... 135/24

FOREIGN PATENT DOCUMENTS 2240038 7/1991 United Kingdom ..... 135/24

*Primary Examiner*—Lanna Mai

[57] ABSTRACT

An automatic umbrella includes a central shaft pivotally secured with a plurality of ribs on the shaft and a handle vertically slidably secured with a push button which can be pushed upwardly for opening the umbrella as urged by an opening spring retained in the shaft and may be pushed downwardly for closing the umbrella as effected by a closing spring retained in the shaft for preventing a confusing or false operation when extending or folding the umbrella.

2 Claims, 4 Drawing Sheets

RELIABLY OPERATED AUTOMATIC UMBRELLA WITH UPWARDLY AND DOWNWARDLY THRUSTED PUSH BUTTON

BACKGROUND OF THE INVENTION

A conventional automatic umbrella is provided with a push button having an upper button portion which is depressed for opening the umbrella and a lower button portion which is depressed for closing the umbrella. whenever opening or closing the umbrella, the umbrella user should be very careful to watch the marking or position of the upper or lower button portion. Otherwise, he or she may depress the false button portion to influence the operation of the umbrella. If it is dark or at night time, the vision is too unclear to distinguish the location of the upper or lower button portion, confusing the umbrella opening or closing operation and causing inconvenience therefor.

The present inventor has found the drawbacks of a conventional automatic umbrella and invented the present umbrella for a clearer operation for opening or closing the umbrella.

SUMMARY OF THE INVENTION

The object of the present invention is to provide an automatic umbrella including a push button which may be pushed upwardly for opening the umbrella and may be pushed downwardly for closing the umbrella for preventing a confusing or false operation when extending or folding the umbrella.

DETAILED DESCRIPTION

Figure 1:
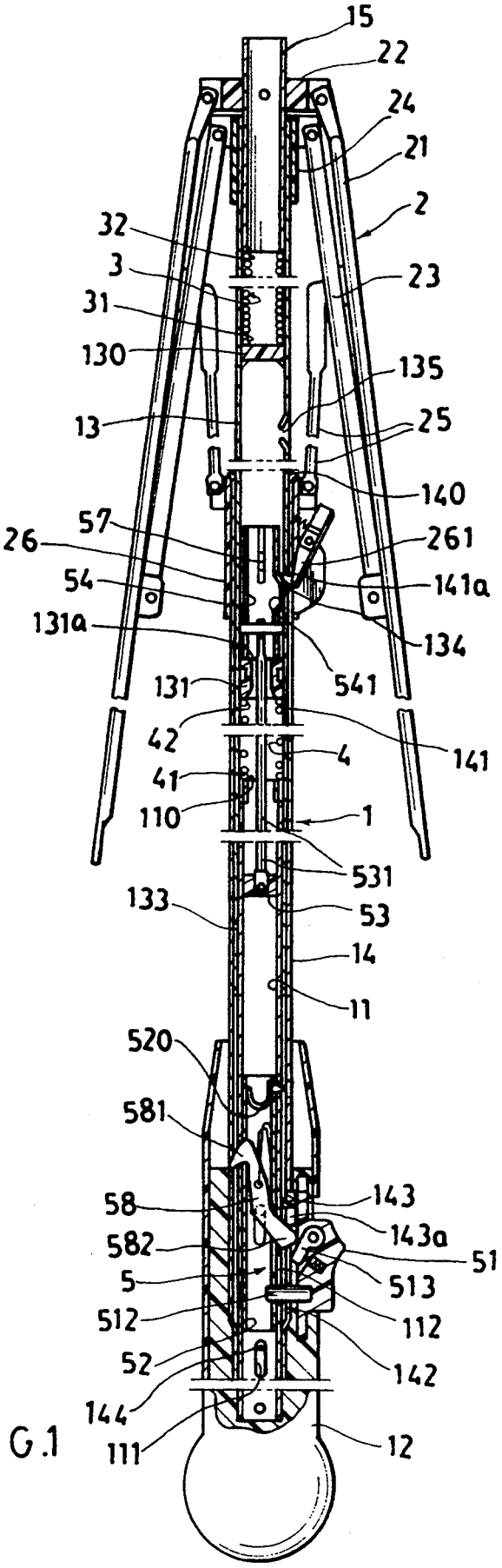
FIG. 1 is an illustration showing a closed umbrella when folded from FIG. 6.

As shown in the drawing figures, the present invention comprises: a central shaft means 1, an umbrella rib means 2, an umbrella-opening spring 3, an umbrella-closing spring 4, and a control means 5.

The central shaft means 1 includes: an inner tube 11 having a lower end portion of the inner tube 11 secured to a handle 12, a middle tube 13 slidably externally disposed about the inner tube 11, an outer tube 14 slidably externally disposed about the middle tube 13, and a top sleeve 15 slidably held in the middle tube 13.

The umbrella rib means 2 includes: a plurality of top ribs 21 each having an inner end (of each top rib 21) said inner end pivotally secured to an upper runner 22 fixed on the top sleeve 15, a plurality of intermediate ribs 23 having an inner end of each intermediate rib 23 pivotally connected with a middle runner 24 fixed on an upper portion of the middle tube 13 and having an outer end of each intermediate rib 23 pivotally connected to each top rib 21, and a plurality of stretcher rib 25 having an inner end of each stretcher rib 25 pivotally secured to a lower runner 26 slidably externally held on the outer tube 14 and having an outer end of each stretcher rib 25 pivotally connected to each top rib 21, with the lower runner 26 having a hook member 261 pivotally mounted in the lower runner 26 and engageable with a lower hook hole 134 formed in the middle tube 13 for closing an umbrella.

The umbrella-opening spring 3 has a lower spring end 31 retained on an upper portion 130 of the middle tube 13 and an upper spring end 32 retained on a bottom portion of the top sleeve 15.

The umbrella-closing spring 4 has a lower spring end 41 retained on an upper end portion 110 of the inner tube 11 and an upper spring end 42 retained on a middle retainer 131 of the middle tube 13.

The control means 5 includes: a push button 51 vertically slidably held in the handle 12, a resilient pawl 513 pivotally resiliently mounted in the push button 51 by a pawl spring **513*a*, a lower control sleeve 52 coupled to the inner tube 11 by a spring catch 520, a lateral pin 512 protruding laterally towards a center of the central shaft means 1, through a lower slot 142 formed in a lower portion of the outer tube 14 and a pin slot 112 formed in a lower portion of the inner tube 11, to be connected to the lower control sleeve 52, a plug 53 having a linking rod 531 protruding upwardly from the plug 13 and slidably held in the inner tube 11, an upper control sleeve 54 connected to the linking rod 531 of the plug 53 and having a convex portion 541 protruding laterally outwardly from the upper control sleeve 54 for outwardly thrusting and disengaging the hook member 261 pivotally mounted on the lower runner 26 for opening an umbrella from its closed state upon an upwardly thrusting of the push button 51 to raise the lower control sleeve 52, the plug 53 and the upper control sleeve 54; a biasing lever 58 pivotally mounted in a lower portion of the inner tube 11 and having an upper hook portion 581 passing through the lower control sleeve 52 and the inner tube 11 for engaging a hook hole 133 formed in the middle tube 13 for coupling the middle tube 13 with the inner tube 11 for compressing the umbrella-closing spring 4 retained between the middle tube 13 and the inner tube 11 and having a lower rod portion 582 passing through the lower control sleeve 52, the inner tube 11 and the outer tube 14 to be operatively depressed by the resilient pawl 513 when downwardly thrusting the push button 51 for disengaging the upper hook portion 581 of the biasing lever 58 from the hook hole 133 in the middle tube 13 for uncoupling the middle tube 13 from the inner tube 11 for releasing the umbrella-closing spring 4** for closing the umbrella from an opened state thereof.

The upper control sleeve 54 includes a resilient retainer 57 protruding laterally from the upper control sleeve 54 to be resiliently held in an inside wall of the middle tube 13 for stably operating the upper control sleeve 54 in the middle tube 13 of the umbrella.

Figure 3:
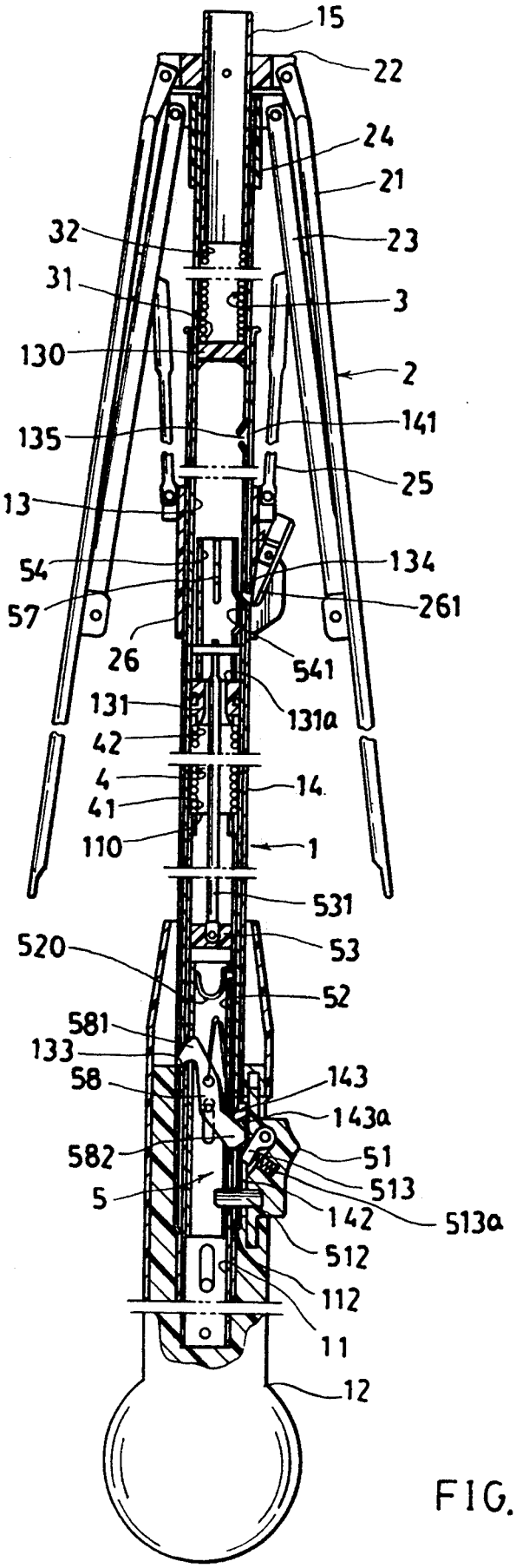
FIG. 3 shows a closed umbrella when resetting a closing spring of the umbrella.
Figure 6:
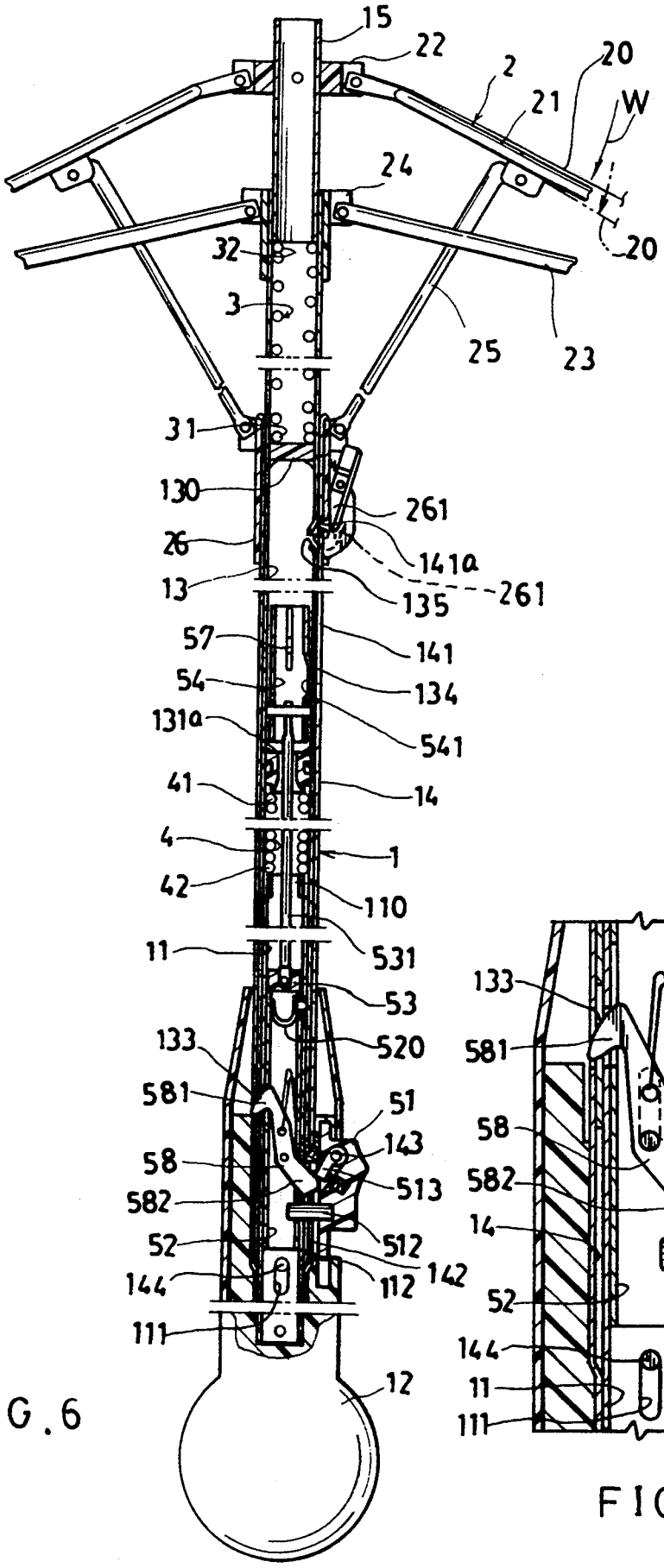
FIG. 6 is an illustration showing an opened umbrella of the present invention.
Figure 7:
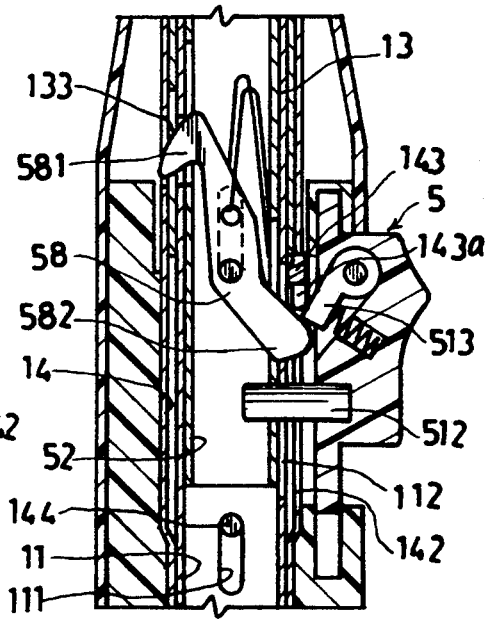
FIG. 7 is a partial enlarged view from FIG. 6 of the present invention.

In operating the present invention for opening the umbrella as shown in FIG. 6 from a closed state as shown in FIG. 3, the push button 51 is thrusted upwardly to raise the lower control sleeve 52, the plug 53 and linking rod 531 and upper control sleeve 54 to allow the protruding convex portion 541 to disengage the hook member 261 of the lower runner 26 from a lower hook hole 134 notched in the middle tube 13 to release the umbrella-opening spring 3, thereby raising the top sleeve 15, the rib means 2 and the lower runner 26 until the hook member 261 is engaged with an upper edge 141*a* of the hook hole 141 recessed in the outer tube 14. The pawl 513 will be moved to be above the lower rod portion 582.

The middle tube 13 is formed with an upper recess 135 converging inwardly in an upper portion of the middle tube 13 adjacent to the hook member 261 of the lower runner 26 to temporarily engage the hook member 261 of the lower runner 26 when an umbrella cloth 20 is subjected to a wind pressure W as shown in FIG. 6 for a buffer of the wind pressure W to present damage to the umbrella.

Whenever the lower runner 26 is raised upon the opening of the umbrella to push a crimping flange 140 formed on a top edge portion of the outer tube 14, the outer tube 14 is pulled upwardly to thereby raise a safety bifurcate member 143, of which two bifurcated arms 143*a* are slidably engageable with the lower rod portion 582 of the biasing lever 58 and normally retards the resilient pawl 513 from contacting the lower rod portion 582 to prevent an unexpected closing of an opening umbrella due to a false depression of the lower rod portion 582 by the resilient pawl 513 of the push button 51 when opening the umbrella, in order to release the safety bifurcate member 143 for an umbrella closing operation from its opened state.

When closing the opened umbrella from FIG. 6 to be a folded situation as shown in FIG. 1, the push button 51 is thrusted downwardly to allow the pawl 513 to depress the lower rod portion 582 of the biasing lever 58 to disengage the upper hook portion 581 from the hook hole 133 of the middle tube 13, to thereby release the compressed umbrella-closing spring 4 to raise the middle tube 13, the middle runner 24 to close the rib means 2 and to lower the runner 26 to allow the hook member 261 (sliding along the hook hole 141 longitudinally formed in the outer tube 14) to re-engage the lower hook hole 134 recessed in the middle tube 13 as shown in FIG. 1. The upper control sleeve 54 is also raised by an upper edge portion 131*a* of the middle retainer 131 of the middle tube to allow the convex portion 541 of the upper control sleeve 54 to approximate the hook member 261 of the lower runner 26 engaged into the lower hook hole 134 of the middle tube 13 ready for a next umbrella opening operation by disengaging the hook member 261 as outwardly thrusted by the convex portion 541. The closing of the umbrella will also compress the umbrella-opening spring 3 to store its resilience energy ready for a next umbrella opening.

Figure 2:
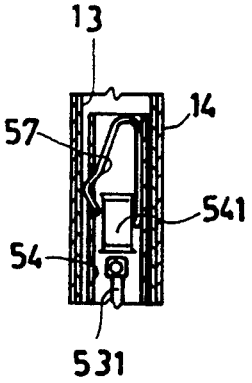
FIG. 2 shows a resilient retainer of an upper control sleeve in accordance with the present invention.

The handle 12 may then be depressed upwardly towards the top sleeve 15 and the middle tube 13 from FIG. 1 to FIG. 3 to compress the umbrella-closing spring 4 for restoring its energy ready for next closing use. The hook hole 133 of the middle tube 13 will be engaged with the upper hook portion 581 of the biasing lever 58 as shown in FIG. 3 for "locking" the umbrella-closing spring 4 at its compressed state.

Figure 4:
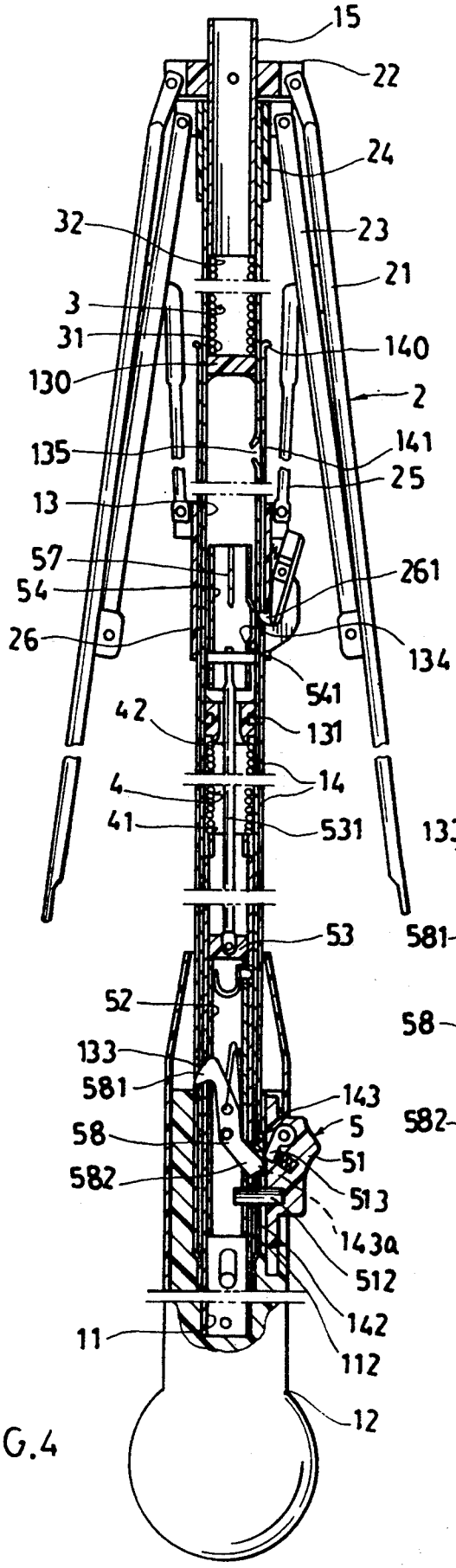
FIG. 4 is an illustration showing an instantly operating condition when opening the umbrella in accordance with the present invention.
Figure 5:
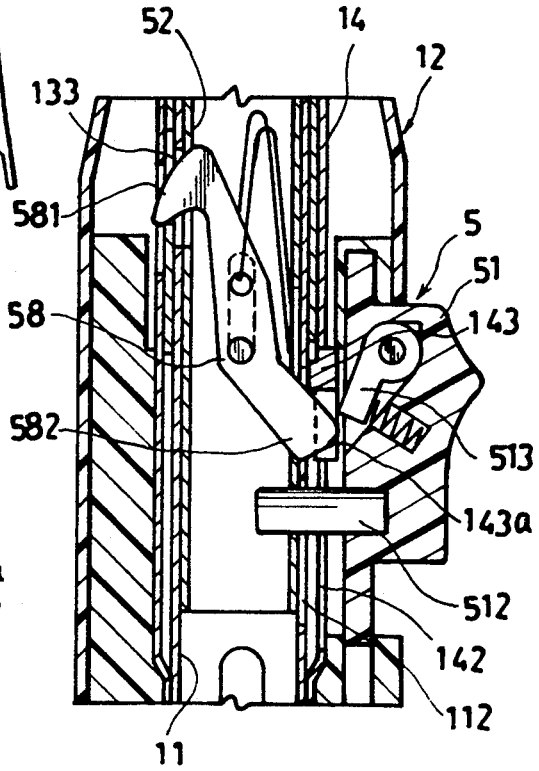
FIG. 5 is a partial enlarged view from FIG. 4 of the present invention.

When re-setting the umbrella-closing spring 4 as shown in FIG. 3 by depressing the handle 12 towards the top sleeve 15 and the middle tube 13, the outer tube 4 with the safety bifurcate member 143 retained thereon will be lowered to allow the safety bifurcate member 143 to shield the lower rod portion 582 of the biasing lever 58 to prevent a false depression on the biasing lever 58 to unexpectedly close an opened umbrella when instantly opening an umbrella as shown in FIGS. 4 and 5. The reciprocal movement of the outer tube 14 on the inner tube 11 may be guided by a pin 144 laterally secured on a lower portion of the outer tube 14 and slidably engageable in an elongate slot 111 cut in a lower portion of the inner tube 11.

The present invention provides a logical operation sequence without causing confusion in opening or closing the umbrella since an upwardly thrusting of the push button 51 will open the umbrella and a downwardly thrusting of the button 51 will close the umbrella.

I claim:

1. An automatic umbrella comprising:

a central shaft means (1) including: an inner tube (11) secured to a handle (12), a middle tube (13) slidably externally disposed about the inner tube (11), an outer tube (14) slidably externally disposed about the middle tube (13), and a top sleeve (15) slidably held in a top portion of the middle tube (13);

an umbrella rib means (2) including: a plurality of top ribs (21) with an inner end of each top rib (21) pivotally secured to an upper runner (22) fixed on the top sleeve (15), a plurality of intermediate ribs (23) with an inner end of each intermediate rib (23) pivotally connected with a middle runner (24) fixed on an upper portion of the middle tube (13) and with an outer end of each intermediate rib (23) pivotally connected to each top rib (21), a plurality of stretcher rib (25) with an inner end of each stretcher rib (25) pivotally secured to a lower runner (26) slidably externally held on the outer tube (14) and with an outer end of each stretcher rib (25) pivotally connected to each top rib (21), and a hook member (261) pivotally mounted in the lower runner (26) and engageable with a lower hook hole (134) formed in the middle tube (13) for closing an umbrella;

an umbrella-opening spring (3) having a lower spring end (31) retained on an upper portion (130) of the middle tube (13) and an upper spring end (32) retained on a bottom portion of the top sleeve (15);

an umbrella-closing spring (4) having a lower spring end (41) retained on an upper end portion (110) of the inner tube (11) and an upper spring end (42) retained on a middle retainer (131) of the middle tube (13); and a control means (5) including: a push button (51) vertically slidably held in the handle (12) with a resilient pawl (513) pivotally resiliently mounted in the push button (51) by a pawl spring (513*a*), a lower control sleeve (52) coupled to the inner tube (11) by a spring catch (520), a lateral pin (512) protruding laterally from said push button (51) to be connected to the lower control sleeve (52), a plug (53) having a linking rod (531) protruding upwardly from the plug (13) and slidably held in the inner tube (11), an upper control sleeve (54) connected to the linking rod (531) of the plug (53) and having a convex portion (541) protruding laterally outwardly from the upper control sleeve (54) for outwardly thrusting and disengaging the hook member (261) pivotally mounted on the lower runner (26) for opening an umbrella from its closed state when the push button (51) is upwardly thrusted to raise the lower control sleeve (52) so as to raise the plug (53) and the upper control sleeve (54), a biasing lever (58) pivotally mounted in a lower portion of the inner tube (11), an upper hook portion (581) of said biasing lever (58) passing through the lower control sleeve (52) and the inner tube (11) for engaging a hook hole (133) formed in the middle tube (13) for coupling the middle tube (13) with the inner tube (11) for compressing the umbrella-closing spring (4) retained between the middle tube (13) and the inner tube (11), a lower rod portion (582) of said biasing lever (58) protruding outwardly from said lever (58) opposite to said upper hook portion (581) to be operatively depressed by the resilient pawl (513) when downwardly thrusting the push button (51) for disengaging the upper hook portion (581) of the biasing lever (58) from the hook hole (133) in the middle tube (13) for uncoupling the middle tube (13) from the inner tube (11) for releasing the umbrella-closing spring (4) for closing the umbrella from an opened state thereof, and a resilient retainer (57) protruding laterally from the upper control sleeve (54) to be resiliently held in an inside wall of the middle tube (13) for stably operating the upper control sleeve (54) in the middle tube (13) of the umbrella;

the improvement which comprises:

said control means (5) including a safety bifurcate member (143) retained on a lower portion of said outer tube (14) normally retarding said resilient pawl (513) from depressing the lower rod portion (582) of said biasing lever (58) before the umbrella being opened, said safety bifurcate member (143) operatively raised to allow a depression of said resilient pawl (513) on said lower rod portion (582) of said biasing lever (58) ready for closing an opened umbrella after opening the umbrella; and said middle tube (13) formed with an upper recess (135) converging inwardly in an upper portion of said middle tube (13) adjacent to the hook member (261) of said lower runner (26) whereby when the umbrella is opened, upon a downwardly moving of said rib means (2) subjected to a downward wind pressure, said hook member (261) will be temporarily engaged into the upper recess (135) in the middle tube for a buffer of the wind pressure.

2. An automatic umbrella according to claim 1, wherein said outer tube (14) is formed a crimped flange (140) on a top edge portion of said outer tube (14), said crimped flange (140) operatively raised by said lower runner (26), when opening the umbrella from a closing state thereof, to raise said outer tube (14) and said safety bifurcate member (143) ready for a closing of an opened umbrella.

* * * * *